US011256188B2

(12) United States Patent
Kaneko et al.

(10) Patent No.: US 11,256,188 B2
(45) Date of Patent: Feb. 22, 2022

(54) TONER, TONER STORED UNIT, AND IMAGE FORMING APPARATUS

(71) Applicant: RICOH COMPANY, LTD., Tokyo (JP)

(72) Inventors: Akihiro Kaneko, Shizuoka (JP); Kazumi Suzuki, Shizuoka (JP); Hisashi Nakajima, Shizuoka (JP); Yoshitaka Yamauchi, Shizuoka (JP); Kohtaroh Ogino, Shizuoka (JP); Teruyuki Suzuki, Shizuoka (JP); Namie Suzuki, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/959,478

(22) PCT Filed: Dec. 26, 2018

(86) PCT No.: PCT/JP2018/047727
§ 371 (c)(1),
(2) Date: Jul. 1, 2020

(87) PCT Pub. No.: WO2019/142630
PCT Pub. Date: Jul. 25, 2019

(65) Prior Publication Data

US 2021/0072656 A1 Mar. 11, 2021

(30) Foreign Application Priority Data

Jan. 18, 2018 (JP) ..... JP2018-006251

(51) Int. Cl.
*G03G 9/097* (2006.01)
*G03G 9/08* (2006.01)
(Continued)

(52) U.S. Cl.
CPC ..... *G03G 9/0819* (2013.01); *G03G 9/0827* (2013.01); *G03G 9/08755* (2013.01); *G03G 9/09725* (2013.01); *G03G 15/0865* (2013.01)

(58) Field of Classification Search
CPC ..... G03G 9/09725
See application file for complete search history.

(56) References Cited

U.S. PATENT DOCUMENTS 9,141,013 B2 9/2015 Moriya et al.
9,348,245 B2 5/2016 Morita et al.
(Continued)

FOREIGN PATENT DOCUMENTS

JP 2006-030662 A 2/2006
JP 2007-256944 A 10/2007
(Continued)

OTHER PUBLICATIONS

International Search Report dated Mar. 15, 2019 for counterpart International Patent Application No. PCT/JP2018/047727 filed Dec. 26, 2018.
(Continued)

*Primary Examiner* — Peter L Vajda
(74) *Attorney, Agent, or Firm* — Grüneberg and Myers PLLC

(57) ABSTRACT

Provided is a toner including toner particles, each toner particle includes: a base particle including a binder resin; and external additive particles, wherein the external additive particles include particles each having an equivalent circle diameter of 10 nm or greater, a volume average particle diameter of the particles each having an equivalent circle diameter of 10 nm or greater is 80 nm or greater but 140 nm or less, and a ratio (circumscribed circle area/particle area) of a circumscribed circle area of the particle having an equivalent circle diameter of 10 nm or greater to a particle
(Continued)

area of the particle having an equivalent circle diameter of 10 nm or greater is 1.60 or greater but 2.60 or less.

8 Claims, 1 Drawing Sheet

(51) Int. Cl.
*G03G 9/087* (2006.01)
*G03G 15/08* (2006.01)

(56) References Cited

U.S. PATENT DOCUMENTS

| | | | | |
|---|---|---|---|---|
| 9,348,259 | B2 | 5/2016 | Nagayama et al. | |
| 9,442,403 | B2 | 9/2016 | Miyaake et al. | |
| 9,482,975 | B2 | 11/2016 | Yamauchi et al. | |
| 9,606,464 | B2 | 3/2017 | Yamauchi et al. | |
| 9,904,190 | B2 | 2/2018 | Dan et al. | |
| 2012/0156601 | A1 | 6/2012 | Kitajima et al. | |
| 2013/0196259 | A1* | 8/2013 | Iida | G03G 9/0804 430/105 |
| 2014/0295340 | A1* | 10/2014 | Iida | G03G 9/08795 430/108.3 |
| 2014/0342286 | A1 | 11/2014 | Yamauchi et al. | |
| 2015/0030819 | A1 | 1/2015 | Naito et al. | |
| 2015/0079512 | A1* | 3/2015 | Sanchez Garcia | C08G 77/38 430/108.3 |
| 2015/0248074 | A1 | 9/2015 | Suzuki et al. | |
| 2015/0253685 | A1 | 9/2015 | Suzuki et al. | |
| 2015/0253688 | A1 | 9/2015 | Yamauchi et al. | |
| 2015/0309433 | A1 | 10/2015 | Sakurada et al. | |
| 2016/0327884 | A1 | 11/2016 | Nakajima et al. | |
| 2017/0075242 | A1 | 3/2017 | Sakai et al. | |
| 2017/0139337 | A1 | 5/2017 | Kaneko et al. | |
| 2017/0212442 | A1 | 7/2017 | Ogino et al. | |
| 2017/0227876 | A1 | 8/2017 | Morooka et al. | |
| 2018/0067409 | A1 | 3/2018 | Yamauchi et al. | |
| 2018/0113391 | A1 | 4/2018 | Yamauchi et al. | |
| 2018/0259864 | A1 | 9/2018 | Suzuki et al. | |
| 2018/0267418 | A1 | 9/2018 | Ogino et al. | |
| 2018/0329326 | A1 | 11/2018 | Matsushita et al. | |

FOREIGN PATENT DOCUMENTS

| | | | |
|---|---|---|---|
| JP | 2007-264142 | A | 10/2007 |
| JP | 2009-229621 | A | 10/2009 |
| JP | 2013156591 | | 8/2013 |
| JP | 5531697 | B2 | 5/2014 |
| JP | 2014191101 | | 10/2014 |
| JP | 5644464 | B2 | 11/2014 |
| JP | 2015-210410 | A | 11/2015 |
| JP | 2017058467 | | 3/2017 |
| JP | 2017142393 | | 8/2017 |

OTHER PUBLICATIONS

Written Opinion dated Mar. 15, 2019 for counterpart International Patent Application No. PCT/JP2018/047727 filed Dec. 26, 2018.
Japanese Office Action dated Oct. 26, 2021 in Japanese Application No. 2018-006251, with English Translation, 8 pages.

* cited by examiner

[Fig. 1]
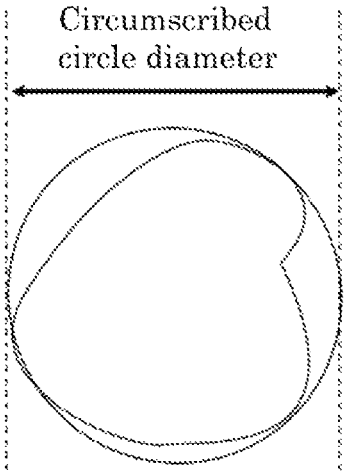
[Fig. 2]
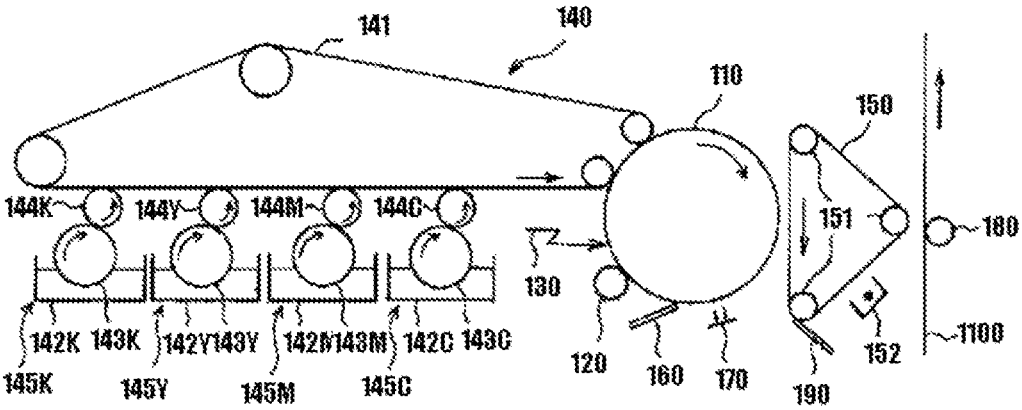

TONER, TONER STORED UNIT, AND IMAGE FORMING APPARATUS

TECHNICAL FIELD

The present disclosure relates to a toner, a toner stored unit, and an image forming apparatus.

BACKGROUND ART

Recently, there are strong demands for high image quality in image formation of electrophotography. To this end, a particle size of a toner has been reduced and a shape of the toner has been made more spherical.

The reduction in the particle size of the toner improves reproducibility of a pixel (dot) of a formed image. In addition, the spherical shape of the toner improves developing properties and transfer properties.

However, the reduction in the particle size of the toner has caused problems, such as undesirable aggregations because the toner particles are easily and closely attached to one another, cleaning failures caused because the toner is easily passed through a gap between a member to be cleaned, such as a photoconductor, and a blade, and filming that can easily occur due to adherence of the toner onto a surface of the photo-conductor. In order to solve the above-described problems, therefore, use of external additives in the toner has been proposed.

As the external additives, for example, a method for using silica having certain characteristics (satisfying certain parameters) has been proposed (see, for example, PTL 1 and PTL 2). Moreover, proposed is a method for externally adding two types of external additives having mutually different sizes in the state of primary particles (see, for example, PTL 3). Furthermore, proposed is a method for using external additives having a large particle size (see, for example, PTL 4).

CITATION LIST

Patent Literature

[PTL 1]
Japanese Unexamined Patent Application Publication No, 2007-264142
[PTL 2]
Japanese Unexamined Patent Application Publication No, 2009-229621
[PTL 3]
Japanese Unexamined Patent Application Publication No, 2006-030662
[PTL 4]
Japanese Patent No. 5644464

SUMMARY OF INVENTION

Technical Problem

The present disclosure has an object to provide a toner having excellent cleaning properties and prevention of photoconductor pollution, with preventing aggregations of the toner even after storage in high temperature and high humidity conditions.

Solution to Problem

According to one aspect of the present disclosure, a toner includes toner particles. Each toner particle includes a base particle including a binder resin, and external additive particles. The external additive particles include particles each having an equivalent circle diameter of 10 nm or greater. A volume average particle diameter of the particles each having an equivalent circle diameter of 10 nm or greater is 80 nm or greater but 140 nm or less. A ratio (circumscribed circle area/particle area) of a circumscribed circle area of the particle having an equivalent circle diameter of 10 nm or greater to a particle area of the particle having an equivalent circle diameter of 10 nm or greater is 1.60 or greater but 2.60 or less.

Advantageous Effects of Invention

The present invention can provide a toner having excellent cleaning properties and prevention of photoconductor pollution, with preventing aggregations of the toner even after storage in high temperature and high humidity conditions.

BRIEF DESCRIPTION OF DRAWINGS

FIG. 1 is a schematic view illustrating one example of a circumscribed circle of an external additive in the present disclosure.

FIG. 2 is a schematic structural view illustrating one example of an image forming apparatus of the present disclosure.

DESCRIPTION OF EMBODIMENTS (Toner)

A toner of the present disclosure includes toner particles and each toner particle includes a base particle and external additive particles.

The base particle includes a binder resin and may further include other components according to the necessity.

The external additive particles include particles each having an equivalent circle diameter of 10 nm or greater.

To date, cleaning failures and filming have been prevented by varying a particle size of an external additive.

As the particle diameters of the external additive increase, adhesion force of the external additive to surfaces of particles of the toner weakens, and the external additive particles are more likely to be released from the toner particles. It has been known that the released external additive particles form aggregates (dam) of the external additive particles at the abutment with a cleaning blade. When the amount of the released external additive particles is large and the released external additive particles are excessively supplied to the dam area, frictions of the particles of the external additive are weak, and the particles are easily moved. In the case where the dam is easily fallen, specifically, photoconductor pollution occurs. This is because part of the dam is fallen over time to pass the external additive a gap between the image bearer and the blade to thereby form a non-abutment (space), which causes cleaning failures or the passed through external additive particles adhered on a surface of the photoconductor. When the particle diameter of the external additive is made small to increase the adhesive force, on the other hand, the external additive does not function as a spacer to deteriorate cohesiveness of the toner.

Considering the above-described points, the present inventors focused on a shape of external additive. The present inventors investigated to make particles of an external additive have shapes that are not true spheres (shapes having high irregularities).

Rolling of particles of the external additive can be suppressed and the particles are made less easily move against one another by enhancing irregularities of the external additive. As a result, slipping of the external additive through a gap between the image bearer and the blade due to the fallen dam, cleaning failures due to the formed non-abutment (space), and photoconductor pollution caused by adhering the passed through the external additive to a surface of the photoconductor can be prevented.

As irregularities of the external additive particles are enhanced, moreover, frictions at the time when the external additive particles are passed through the abutment surface between the photoconductor and the cleaning blade to improve an effect of scraping the photoconductor. Therefore, the attachment of the pollutants on the photoconductor is suppressed.

The present inventors have studied the above-described factors. As a result, the present inventors have found that a toner having excellent cleaning properties and prevention of photoconductor pollution with preventing aggregations of the toner particles can be provided when external additive for use satisfies the following conditions.

External additive of a large particle size, where the external additive has a volume average particle diameter of 80 nm or greater but 140 nm or less.

External additive particles are formed of aggregates and a circumscribed circle area is 1.60 times or greater but 2.60 times or less a particle area.

<External Additive Particles>

The external additive particles are not particularly limited and may be appropriately selected depending on the intended purpose. Examples of the external additive particles include inorganic particles.

The inorganic particles are not particularly limited and may be appropriately selected depending on the intended purpose. Examples of the inorganic particles include silica, alumina, titanium oxide, barium titanate, magnesium titanate, calcium titanate, strontium titanate, a fluorine compound, iron oxide, copper oxide, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and, silicon nitride. The above-listed examples may be used alone or in combination. Note that, in the case where two or more kinds of inorganic particles are used in combination, the inorganic particles are preferably selected in a manner that the selected inorganic particles have resistance against developing stress, such as idling. Among the above-listed examples, silica, titanium oxide, strontium titanate, and alumina are preferable. Moreover, the silica is preferably fumed silica because silica particles having high irregularities are easily produced with the fumed silica.

Shapes of the external additive particles are preferably shapes having irregularities rather than true spheres. Specifically, the external additive particle is preferably an aggregate (secondary particle) formed of an agglomerate. When the external additive particle is formed of an aggregate, a problem that there is a limitation in making irregular shapes can be prevented. In the case where particles that are aggregates are used as the external additive particles, it is necessary to increase particle diameters of the external additive particles to make a ratio between the circumscribed circle area and the particle area large as in the present disclosure.

The equivalent circle diameter of the external additive particle is 10 nm or greater.

The maximum value of the equivalent circle diameter of the external additive particle is not particularly limited and may be appropriately selected depending on the intended purpose. The maximum value is preferably 250 nm or less.

A volume average particle diameter of the external additive particles (particles each having an equivalent circle diameter of 10 nm or greater) is 80 nm or greater but 140 nm or less, and preferably 90 nm or greater but 130 nm or less. When the volume average particle diameter is less than 80 nm, a function of the external additive as a spacer decreases to impair aggregations between toner particles. When the volume average particle diameter is greater than 140 nm, moreover, adhesion of the external additive particles to surfaces of the toner particles weakens to release the external additive particles, excessive supply of the external additive particles to the dam area occurs, and particles are not easily closely attached to one another, thus part of the dam is easily fallen to cause cleaning failures or significant photoconductor pollution.

A ratio (circumscribed circle area/particle area) of the circumscribed circle area of the external additive particle (particle having an equivalent circle diameter of 10 nm or greater) to the particle area of the particle having an equivalent circle diameters of 10 nm or greater is 1.60 or greater but 2.60 or less, and preferably 1.65 or greater but 2.00 or less. When the ratio (area ratio) is less than 1.60, the shapes are close to spheres and therefore cleaning properties deteriorate. When a volume average particle diameter is relatively small and the ratio is less than 1.60, cohesiveness of the toner particles deteriorate. When the ratio (area ratio) is greater than 2.60, retention of the external additive particles on surfaces of the toner particles is poor. Moreover, the charging properties are not stabilized over time and functions as a toner are not exhibited. The ratio (area ratio) is a parameter for indicating irregularities of the external additive particles. When irregularities are indicated, an average circularity calculated from a ratio between a particle area and a square of a perimeter is typically used. However, the average circularity is insufficient for indicating irregularities of shapes. In the present disclosure, therefore, a degree of irregularities is represented by a ratio between a circumscribed circle area and a particle area.

FIG. 1 illustrates a circumscribed circle of the external additive particle.

—Measurements of Equivalent Circle Diameter, Volume Average Particle Diameter, and Area Ratio (Circumscribed Circle Area/Particle Area)—

In the present disclosure, an equivalent circle diameter, particle area, and circumscribed circle area of the external additive particle are measured in the state where the external additive particles are deposited on surfaces of the toner particles by observing the toner after external addition of the external additive particles.

Specifically, the measurements can be performed in the following manner. For example, a toner image is obtained by means of a scanning electron microscope SU8200 series (available from Hitachi High-Technologies Corporation). The obtained image is binarized using image processing software, A-zou kun (available from Asahi Kasei Engineering Corporation), to thereby calculate an equivalent circle diameter, a particle area, and a circumscribed circle area.

The calculation is performed using "Equivalent Circle Diameter 2," "Area," and "Circumscribed Circle Diameter" obtained by the particle analysis mode of A-zou kun.

The equivalent circle diameter is a value obtained by converting the value into a value of a diameter with the determination that the above-obtained value is a value of a circular area.

As the particle area, the value of "Area" obtained by the binarization can be used as it is.

The circumscribed circle area is calculated from "Circumscribed Circle Diameter" obtained by the binarization.

The area ratio (circumscribed circle area/particle area) is obtained by dividing the "average of circumscribed circles" obtained above with the "average of particle areas" obtained above.

A volume average particle diameter is obtained by calculating a volume from the above-obtained equivalent circle diameter using the same software and dividing a sum of products of each particle diameter and volume with a sum of volumes ([total of (particle diameter×volume) of measured particles/total of volumes of measured particles]).

The details of analysis conditions of the above-mentioned analysis are as follows.

Binarization method (threshold): manual setting (visually)

Range designation: yes

Outer rim correction: no

Gap filling: yes

Contraction separation: no

The reason why the binarization threshold is manually set above is to distinguish between irregularities on surfaces of particles of a toner and the external additive. In the case where a change in contrast is significant on the same image at the time of binarization, an analysis range is designated to around 1 particle and the observation is performed on the 1 particle and the surrounding area of the 1 particle to set as a threshold.

An amount of the external additive particles is not particularly limited and may be appropriately selected depending on the intended purpose. The amount of the external additive particles is preferably from 0.3 percent by mass through 5.5 percent by mass relative to all of the below-mentioned base particles.

<Base Particles>

Each of the base particles (may be also referred to as "toner base particles") includes a binder resin and may further include other components according to the necessity.

<<Binder Resin>>

The binder resin is not particularly limited and may be appropriately selected depending on the intended purpose. Examples of the binder resin include a styrene-based resin (a homopolymer or copolymer of styrene or substituted styrene), a vinyl chloride resin, a styrene/vinyl acetate copolymer, a rosin-modified maleic acid resin, a phenol resin, an epoxy resin, a polyethylene resin, a polypropylene resin, an ionomer resin, a polyurethane resin, a silicone resin, a ketone resin, an ethylene/ethyl acrylate copolymer, a xylene resin, a polyvinyl butyral resin, a petroleum resin, and a hydrogenated petroleum resin.

Examples of the styrene-based resin (e.g., a homopolymer or copolymer including styrene or substituted styrene) include polystyrene, chloropolystyrene, poly-alpha-methylstyrene, a styrene/chlorostyrene copolymer, a styrene/propylene copolymer, a styrene/butadiene copolymer, a styrene/vinyl chloride copolymer, a styrene/vinyl acetate copolymer, a styrene/maleic acid copolymer, a styrene/acrylic acid ester copolymer (e.g., a styrene/methyl acrylate copolymer, a styrene/ethyl acrylate copolymer, a styrene/butyl acrylate copolymer, a styrene/octyl acrylate copolymer, and a styrene/phenyl acrylate copolymer), a styrene/methacrylic acid ester copolymer (e.g., a styrene/methyl methacrylate copolymer, a styrene/ethyl methacrylate copolymer, a styrene/butyl methacrylate copolymer, and a styrene/phenyl methacrylate copolymer), a styrene/methyl alpha-chloroacrylate copolymer, and a styrene/acrylonitrile/acrylic acid ester copolymer.

The above-listed examples may be used alone or in combination. Among the above-listed examples, a polyester resin is preferable in view of low temperature fixing ability and safety to the environment (VOC due to residual monomers).

<<<Polyester Resin>>

As the polyester resin, any resin obtained from a polycondensation reaction between alcohol and acid known in the art can be used.

Examples of the alcohol include diols, etherified bisphenols, divalent alcohol monomers obtained by substituting the above-listed alcohols with a saturated or unsaturated hydrocarbon group having from 3 through 22 carbon atoms, and higher alcohol monomers that are trivalent or higher.

Examples of the diols include polyethylene glycol, diethylene glycol, triethylene glycol, 1,2-propyleneglycol, 1,3-propyleneglycol, 1,4-propyleneglycol, neopentyl glycol, and 1,4-butenediol.

Examples of the etherified bisphenols include 1,4-bis(hydroxymethyl)cyclohexane, bisphenol A, hydrogenated bisphenol A, polyoxyethylated bisphenol A, and polyoxypropylated bisphenol A.

Examples of the higher alcohol monomers that are trivalent or higher include sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylol ethane, trimethylol propane, and 1,3,5-trihydroxymethylbenzene.

The above-listed examples may be used alone or in combination.

Examples of the carboxylic acid include monocarboxylic acid, divalent organic acid monomers, anhydrides of the above-listed acids, dimers of lower alkyl ester and linoleic acid, and trivalent or higher polyvalent carboxylic acid monomers.

Examples of the monocarboxylic acid include palmitic acid, stearic acid, and oleic acid.

Examples of the divalent organic acid monomers include maleic acid, fumaric acid, mesaconic acid, citraconic acid, terephthalic acid, cyclohexane dicarboxylic acid, succinic acid, adipic acid, sebacic acid, malonic acid, and the above-listed acids substituted with a saturated or unsaturated hydrocarbon group having from 3 through 22 carbon atoms.

Examples of the trivalent or higher polyvalent carboxylic acid monomers include 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid empol trimer acid, and anhydrides of the above-listed acids.

The above-listed examples may be used alone or in combination.

A production method of the binder resin is not particularly limited and may be appropriately selected. For example, bulk polymerization, solution polymerization, emulsion polymerization, or suspension polymerization can be used.

<<Other Components>>

The above-mentioned other components are not particularly limited and may be appropriately selected depending on the intended purpose, as long as the components are components typically used for a toner. Examples thereof include a colorant, a release agent, a trivalent or higher metal salt, and a wax dispersing agent.

<<<Colorant>>>

As a colorant for use in the toner of the present disclosure, any of dyes or pigments known in the art can be used. Examples of the dyes and pigments include carbon black, lamp black, iron black, aniline blue, phthalocyanine blue, phthalocyanine green, Hansa Yellow G, Rhodamine 6C Lake, calco oil blue, chrome yellow, quinacridone, benzidine yellow, rose bengal, and a triallyl methane-based dye. The above-listed colorants may be used alone or in combination, and may be used for a black toner or full-color toners.

An amount of the colorant is preferably from 1 percent by mass through 30 percent by mass, and more preferably from 3 percent by mass through 20 percent by mass relative to the binder resin component of the toner.

<<<Release Agent>>>

The release agent (wax) is not particularly limited and may be appropriately selected depending on the intended purpose as long as the release agent is a release agent typically used for a toner. The release agent is preferably monoester wax. Since the monoester wax has low compatibility to a typical binder resin, the monoester wax easily bleeds out to a surface of the toner particle at the time of fixing to exhibit high releasing properties, to thereby secure high glossiness and low temperature fixing ability.

Moreover, an amount of the monoester wax is preferably from 5 parts by mass through 10 parts by mass and more preferably from 6 parts by mass through 9 parts by mass relative to 100 parts by mass of the toner. When the amount thereof is less than 5 parts by mass, bleeding of the monoester wax onto surfaces of particles of the toner is insufficient at the time of fixing, releasing properties are poor, and gloss, low temperature fixing ability and hot offset resistance are low. When the amount thereof is greater than 10 parts by mass, an amount of the release agent precipitated on surfaces of particles of the toner increases, and therefore storage stability of the toner deteriorates, and filming may occur on a photoconductor.

The monoester wax is preferably synthetic ester wax. Examples of the synthetic ester was include monoester wax synthesized from a long straight chain saturated fatty acid and long straight chain saturated alcohol. The long straight chain saturated fatty acid is preferably represented by a general formula, $C_nH_{2n+1}COOH$, where n is from about 5 through about 28. The long straight chain saturated alcohol is preferably represented by $C_nH_{2n+1}OH$, where n is from about 5 through about 28.

Specific examples of the long straight chain saturated fatty acid include capric acid, undecylic acid, lauric acid, tridecylic acid, myristic acid, pentadecylic acid, palmitic acid, heptadecanoic acid, tetradecanoic acid, stearic acid, nonadecanoic acid, aramonic acid, behenic acid, lignoceric acid, cerotic acid, heptacosanoic acid, montanic acid, and melissic acid.

Specific examples of the long chain straight chain saturated alcohol include amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecanol, where the above-listed alcohols may have a substituent, such as a lower alkyl group, an amino group, and halogen.

<<<Trivalent or Higher Metal Salt>>>

The toner of the present disclosure preferably includes a trivalent or higher metal salt. Since the toner includes the metal salt, a cross-linking reaction with an acid group of a binder resin progresses at the time of fixing to form weak three-dimensional crosslinks, to thereby obtain hot offset resistance with maintaining low temperature fixing ability.

For example, the metal salt is at least one of a metal salt of a salicylic acid derivative and an acetyl acetonate metal salt. The metal is not particularly limited as long as the metal is a trivalent or higher polyvalent metal. Examples of the metal include iron, zirconium, aluminium, titanium, and nickel.

The trivalent or higher metal salt is preferably a trivalent or higher salicylic acid metal compound.

An amount of the metal salt is, for example, preferably from 0.5 parts by mass through 2 parts by mass, more preferably from 0.5 parts by mass through 1 part by mass, relative to 100 parts by mass of the toner. When the amount is from 0.5 parts by mass through 2 parts by mass, the following problems can be prevented.

Problem of poor hot offset resistance

Problem of poor glossiness and low temperature fixing ability

<<<Wax Dispersing Agent>>>

The toner of the present disclosure preferably include a wax dispersing agent. The dispersing agent is preferably a copolymer composition including at least styrene, butyl acrylate, and acrylonitrile as monomers, or a polyethylene adduct of the copolymer composition.

An amount of the wax dispersing agent is preferably 7 parts by mass or less relative to 100 parts by mass of the toner. An effect of dispersing wax can be obtained by adding the wax dispersing agent, and an improvement in stable storage stability can be expected regardless of a production method. Moreover, diameters of wax become small owing to an effect of dispersing wax to thereby prevent a filming effect to a photoconductor. When the amount is 7 parts by mass or less, the following problems can be prevented.

Problem that a non-compatible component to a polyester resin increases to reduce glossiness Problem that bleeding of wax to surfaces of the toner is poor at the time of fixing to reduce low temperature fixing ability and hot offset resistance <Properties of Toner>

<<Volume Average Particle Diameter of Toner>>

A volume average particle diameter of the toner of the present disclosure is preferably from 3 micrometers through 10 micrometers.

The volume average particle diameter of the toner is measured by various methods. For example, Coulter Counter Multisizer III is used for a measurement. As a measurement sample, a toner to be measured is added to an electrolyte to which a surface is added and the resultant is dispersed for 1 minute by means of an ultrasonic wave disperser, to thereby prepare the sample. The measurement is performed on 50,000 particles to determine a volume average particle diameter.

<<Measurement of Molecular Weight of Binder Resin>>

A number average molecular weight and a weight average molecular weight of the binder resin may be measured by various methods. For example, the number average molecular weight and the weight average molecular weight can be measured by measuring a molecular weight distribution of a THF-soluble component by means of a gel permeation chromatography (GPC) measuring device GPC-150C (available from WATERS) in the following manner.

Specifically, the measurement is performed according to the following method using columns (KF801 to 807, available from Shodex). The columns are stabilized in a heat chamber of 40 degrees Celsius. As a solvent, THF is streamed into the columns at 40 degrees Celsius at a flow rate of 1 mL/min. After sufficiently dissolving 0.05 g of a sample in 5 g of THF, the resultant solution is filtered through a filter for a pre-treatment (for example, a chromatodisk having a pore diameter of 0.45 micrometers (available from KURABO INDUSTRIES LTD.)) to ultimately prepare a THF sample solution of the resin that has a sample concentration of from 0.05 percent by weight through 0.6 percent by weight. The prepared THF sample solution (from 50 microliters through 200 microliters) is injected for measurement. As for a weight average molecular weight Mw and a number average molecular weight Mn of the THF-soluble component of the sample, a molecular weight distribution of the sample can be calculated from the correlation between the logarithmic values of the number of counts of the calibration curve that is prepared from monodisperse polystyrene standard samples.

As standard polystyrene samples for preparing a calibration curve, for example, polystyrene samples having molecular weights of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$, and $4.48\times10^6$ available from Pressure Chemical Co. (or TOSOH CORPORATION) can be used. It is appropriate that at least about 10 standard polystyrene samples are used. Moreover, a refractive index (RI) detector is used as a detector.

<<Measurement of Glass Transition Temperature (Tg) of Binder Resin>>

In the present disclosure, for example, a glass transition temperature (Tg) can be measured by means of a differential scanning calorimeter (DSC210, available from Seiko Instruments Inc.). Specifically, a sample is weighed by from 0.01 g through 0.02 g in an aluminium pan. The sample is heated to 200 degrees Celsius, then is cooled from 200 degrees Celsius to 20 degrees Celsius at a cooling speed of 10 degrees Celsius/min, and then heated at a heating speed of 10 degrees Celsius/min. A temperature of a cross point between an extended line of a base line equal to or lower than the maximum endothermic peak temperature and a tangent line exhibiting the maximum inclination from a rising part of a peak to an apex of the peak is determined as a glass transition temperature.

<Production Method of Toner>

The toner of the present disclosure can be obtained by externally adding the external additive particles to each of the toner base particles.

For example, the toner base particles can be obtained by various production methods, such as a pulverization method and a polymerization method (suspension polymerization, emulsion polymerization, dispersion polymerization, emulsification aggregation, and emulsification association).

Next, inorganic particles are externally added to each of the toner base particles. The toner base particles and the inorganic particles are mixed and stirred by means of a mixer to crush the inorganic particles that are an external additive to cover surfaces of the toner base particles with the inorganic particles.

A mixing device that can be used is not particularly limited as long as the mixing device can mix powder. Any device known in the art can be used as the mixing device. Examples of the mixing device include a V-shaped mixer, Rocking Mixer, Loedige Mixer, Nauta Mixer, Henschel Mixer, and Q Mixer. The mixing device is preferably a mixing device equipped with a jacket and capable of adjusting an internal temperature.

Adhesion strength of the inorganic particles to surfaces of the toner base particles can be controlled by changing circumferential speed of a rotating blade of a mixing device, or changing duration of mixing and stirring. When the inorganic particles are externally added with applying heat inside the mixing device, surfaces of the toner base particles are softened and the inorganic particles can be embedded into the toner base particles. Therefore, the adhesion strength to the surfaces of the toner base particles can be controlled.

Since the external additive for use in the present disclosure is highly irregular in a shape thereof and easily released, a total external addition time (duration of stirring) is preferably set to from 16 minutes through 25 minutes. When the external addition time is from 16 minutes through 25 minutes, the following problems can be prevented.

Problem that an amount of free external additive is excessive to cause cleaning failures and photoconductor pollution.

Problem that stress applied to the external additive during a mixing treatment is too weak and therefore irregularity of the shapes is high and the area ratio does not satisfy the range of 2.6 or less.

Problem that the external additive particles are embedded in the toner base particles and therefore an effect of the external additive as a spacer is not exhibited.

Problem that the shapes become close to spheres due to external stress at the time of the mixing treatment and therefore the area ratio does not satisfy the range of 1.6 or greater.

<Developer>

A developer of the present disclosure includes at least the toner and may further include appropriately selected other components, such as a carrier, according to the necessity.

Therefore, the developer has excellent transfer properties and charging properties, and can stably form an image of a high image quality. Note that, the developer may be a one-component developer or a two-component developer. When the developer is used for a high-speed printer corresponds to recent improved information processing speed, the developer is preferably a two-component developer because a service life is improved.

The carrier is appropriately selected depending on the intended purpose. Examples of the carrier include a magnetic carrier and a resin carrier.

The magnetic carrier is preferably magnetic particles. Examples of the magnetic particles include: spinel ferrite, such as magnetite and gamma iron oxide; spinel ferrite including one or two or more metals (e.g., Mn, Ni, Zn, Mg, and Cu) excluding iron; magnetoplumbite ferrite, such as barium ferrite; and particles of iron or alloy where the particles each has an oxide layer at a surface of the particle. Among the above-listed examples, particularly in the case where high magneticity is required, ferromagnetic particles, such as iron, are preferable.

A shape of the carrier may be a granular shape, spherical shape, or needle shape. In view of chemical stability, moreover, spinel ferrite including gamma iron oxide or magnetoplumbite ferrite, such as barium ferrite, is preferably used. A resin carrier having desired magneticity can be also used by selecting a type and amount of the ferromagnetic particles. As the magnetic properties of the carrier, the strength of the magnetization at 1,000 oersted is preferably from 30 emu/g through 150 emu/g.

The resin carrier can be produced by spraying a melt-kneaded product including magnetic particles and an insulating binder resin by means of a spray dryer. Specifically, a monomer or prepolymer is allowed to react and cure in an aqueous medium in the presence of magnetic particles to thereby produce a resin carrier in which the magnetic particles are dispersed in the condensed binder.

Charging ability of the magnetic carrier can be controlled by adhering positively or negatively chargeable particles or conductive particles on surfaces of particles of the magnetic carrier, or coating surfaces of the particles of the magnetic carrier with a resin.

As a surface coating material, a silicone resin, an acrylic resin, an epoxy resin, and a fluororesin are used. The surface coating material may coat carrier articles with including therein positively or negatively chargeable particles or conductive particles. The surface coating material is preferably a silicone resin and an acrylic resin.

A blending ratio between the electrophotographic toner of the present disclosure and the magnetic carrier is preferably, as a toner density, from 2 percent by mass through 10 percent by mass.

(Toner Stored Unit)

A toner stored unit of the present disclosure is a unit that has a function of storing a toner and stores the toner. Examples of embodiments of the toner stored unit include a toner stored container, a developing device, and a process cartridge.

The toner stored container is a container in which a toner is stored.

The developing device is a device including a unit configured to store a toner and develop.

The process cartridge is a process cartridge which includes at least an electrostatic latent image bearer (also referred to as an image bearer) and a developing unit that are integrated, stores a toner, and is detachably mounted in an image forming apparatus. The process cartridge may further include at least one selected from a charging unit, an exposing unit, and a cleaning unit.

When the toner stored unit of the present disclosure is mounted in an image forming apparatus and image formation is performed by the image forming apparatus, images having image stability over a long period and having high quality and precision can be formed using the following characteristics of the toner. The characteristics of the toner are that defected images due to filming of the external additive on the photoconductor are not formed even through the toner is repeatedly used over a long period particularly in a low temperature and low humidity environment and high image density can be stably secured.

(Image Forming Apparatus and Image Forming Method)

An image forming apparatus of the present disclosure includes at least an electrostatic latent image bearer, an electrostatic latent image forming unit, and a developing unit. The image forming apparatus may further include other units according to the necessity.

An image forming method associated with the present disclosure includes at least an electrostatic latent image forming step and a developing step. The image forming method may further include other steps according to the necessity.

The image forming method is preferably performed by the image forming apparatus. The electrostatic latent image forming step is preferably performed by electrostatic latent image forming unit. The developing step is preferably performed by the developing unit. The above-mentioned other steps are preferably performed by the above-mentioned other units.

The image forming apparatus of the present disclosure more preferably includes an electrostatic latent image bearer, an electrostatic latent image forming unit configured to form an electrostatic latent image on the electrostatic latent image bearer, a developing unit including a toner and configured to develop the electrostatic latent image formed on the electrostatic latent image bearer with the toner to form a toner image, a transferring unit configured to transfer the toner image formed on the electrostatic latent image bearer to a surface of a recording medium, and a fixing unit configured to fix the toner image transferred to the surface of the recording medium.

Moreover, the image forming method of the present disclosure more preferably includes an electrostatic latent image forming step, a developing step, a transferring step, and a fixing step. The electrostatic latent image forming step includes forming an electrostatic latent image on an electrostatic latent image bearer. The developing step includes developing the electrostatic latent image formed on the electrostatic latent image bearer with a toner to form a toner image. The transferring step includes transferring the toner image formed on the electrostatic latent image bearer to a surface of a recording medium. The fixing step include fixing the toner image transferred to the surface of the recording medium.

In the developing unit and the developing step, the toner is used. Preferably, the toner image may be formed by using a developer including the toner and optionally further including other ingredients, such as a carrier.

<Electrostatic Latent Image Bearer>

A material, structure, and size of the electrostatic latent image bearer (also referred to as a "photoconductor" hereinafter) are not particularly limited and may be appropriately selected from those known in the art. Examples of the material of the electrostatic latent image bearer include inorganic photoconductors (e.g., amorphous silicon and selenium) and organic photoconductors (e.g., polysilane and phthalopolymethine).

<Electrostatic Latent Image Forming Unit>

The electrostatic latent image forming unit is not particularly limited and may be appropriately selected depending on the intended purpose, as long as the electrostatic latent image forming unit is a unit configured to form an electrostatic latent image on the electrostatic latent image bearer. Examples of the electrostatic latent image forming unit include a unit including at least a charging member configured to charge a surface of the electrostatic latent image bearer and an exposure member configured to expose the surface of the electrostatic latent image bearer to imagewise light.

<Developing Unit>

The developing unit is not particularly limited and may be appropriately selected depending on the intended purpose, as long as the developing unit is a developing unit, which is configured to develop the electrostatic latent image formed on the electrostatic latent image bearer to form a visible image and includes a toner.

<Other Units>

Examples of the above-mentioned other units include a transferring unit, a fixing unit, a cleaning unit, a charge-eliminating unit, a recycling unit, and a controlling unit.

The image forming apparatus of the present disclosure preferably does not include a lubricant applying unit. The lubricant applying unit is a unit configured to apply a lubricant to a photoconductor.

The lubricant is a lubricant to be applied to a surface of a photoconductor. Examples of the lubricant include zinc stearate.

For example, the purpose for applying the lubricant is as follows.

Behavior of a cleaning blade edge is stabilized by lowering a coefficient of friction (micro) to support a cleaning unit.

A surface of a photoconductor is protected from charging current when AC voltage is applied to a charging roller.

Pollution caused by adherence of a toner component to an image bearer, an external additive, or paper dust is suppressed by scraping a lubricant applied to a surface of the image bearer using a cleaning blade.

As a method for applying a lubricant, for example, there is a system where a lubricant is applied to a surface of an image bearer by a brush roller. The lubricant is collected by scratching a solid lubricant that is a bulk of the lubricant and can be applied to a surface of the image bearer.

In an image forming apparatus that does not include a lubricant applying unit, generally, cleaning failures occur because the behavior of the cleaning blade edge is not stabilized, and moreover the surface abrasion increases because the cleaning blade is brought into direct contact with the image bearer.

According to the present disclosure, however, the above-described cleaning failures hardly occur because irregularities in a shape of the external additive are high.

Next, an embodiment for carrying out a method for forming an image using the image forming apparatus of the present disclosure will be described with reference to FIG. 2.

FIG. 2 is a schematic structural view illustrating one example of the image forming apparatus. Around a photoconductor drum (referred to as a photoconductor hereinafter) 110 serving as an image bearer, a charging roller 120 serving as a charging device, an exposure device 130, a cleaning device 160 including a cleaning blade, a charge-eliminating lamp 170 serving as a charge-eliminating device, a developing device 140, and an intermediate transfer member 150 serving as an intermediate transfer member are arranged. The intermediate transfer member 150 is supported by a plurality of suspension rollers 151 and is designed in a manner that the intermediate transfer member is driven endlessly in the direction indicated by the arrow by a driving unit that is not illustrated, such as a motor. Part of the suspension rollers 151 also function as transfer bias rollers configured to supply transfer bias to the intermediate transfer member. Transfer bias voltage is applied to the transfer bias rollers from a power source that is not illustrated. Moreover, a cleaning device 190 having a cleaning blade for the intermediate transfer member 150 is also arranged. Moreover, a transfer roller 180 is arranged to face the intermediate transfer member 150 where the transfer roller 180 serves as a transfer unit configured to transfer a developed image to transfer paper 1100 serving as a final transfer material. Transfer bias is applied to the transfer roller 180 from a power source that is not illustrated. Then, a corona charger 152 serving as a charge applying unit is disposed around the intermediate transfer member 150.

The developing device 140 includes a developing belt 141 serving as a developer bearer, and a black (referred to as Bk hereinafter) developing unit 145K, a yellow (referred to as Y hereinafter) developing unit 145Y, a magenta (referred to as M hereinafter) developing unit 145M, and a cyan (referred to as C hereinafter) developing unit 145C arranged together around the developing belt 141. Moreover, the developing belt 141 is supported by a plurality of belt rollers and is designed in a manner that the developing belt is driven endlessly in the direction indicated by the arrow by a driving unit that is not illustrated, such as a motor. Moreover, the developing belt travels at the substantially same speed to the speed of the photoconductor 110 at the contact area with the photoconductor 110.

Since the structures of all of the developing units are identical, only the Bk developing unit 45K will be described below, and the descriptions of the other developing units 145Y, 145M, and 145C are omitted with applying Y, M, and C after the number applied to the unit at the area corresponding to the Bk developing unit 145K in the drawings. The Bk developing unit 145K include a developing tank 142K stored therein a liquid developer of high viscosity and high concentration where the liquid developer includes toner particles and a carrier liquid component, a drawing roller 143K arranged in a manner that the bottom of the drawing roller 143K is dipped in the liquid developer inside the developing tank 142K, and a coating roller 144K configured to thin the developer drawn up by the drawing roller 143K and apply the developer onto the developing belt 141. The coating roller 144K has conductivity and the predetermined bias is applied to the coating roller 144K from a power source that is not illustrated.

Subsequently, the operation of the image forming apparatus according to the present embodiment will be described. In FIG. 2, the photoconductor 110 is rotationally driven in the direction indicated with the arrow and the photoconductor 110 is uniformly charged by a charging roller 120. Thereafter, reflection light from a document is formed into an image and projected by an optical system that is not illustrated to form an electrostatic latent image on the photoconductor 110 by the exposure device 130. The electrostatic latent image is developed by the developing device 140 to form a toner image as a visible image. The developing layer on the developing belt 141 is released from the developing belt 141 in the state of a thin layer by contact with a photoconductor in a developing region and is transferred to an area where the latent image is formed on the photoconductor 110. The toner image developed by the developing device 140 is transferred (primary transferred) to a surface of the intermediate transfer member 150 at the abutment (primary transfer region) with the intermediate transfer member 150 that travels the same speed as the speed of the photoconductor 110. In the case where transfer is performed to superimpose 3 or 4 colors, the above-described process is performed for each layer to form a color image on the intermediate transfer member 150.

The corona charger 152 configured to apply charge to the superimposed toner images on the intermediate transfer member is disposed at the position that is downstream of the contact facing area between the photoconductor 110 and the intermediate transfer member 150 and upstream of the contact facing area between the intermediate transfer member 150 and transfer paper 1100 relative to the rotational direction of the intermediate transfer member 150. Then, the corona charger 152 applies true electric charge to the toner images where the true electric charge has the same polarity to the charge polarity of the toner particles constituting the toner images, and the corona charger applies sufficient charge to the toner to perform excellent transfer to the transfer paper 1100. After charging the toner images by the corona charger 152, the toner images are collectively transferred (secondary transferred), by transfer bias from the transfer roller 180, to the transfer paper 1100 transported from a paper feeding unit that is not illustrated in the direction indicated with the arrow. Thereafter, the transfer paper 1100, on which the toner images have been transferred, is separated from the photoconductor 110 by a separation device that is not illustrated, a fixing treatment is performed thereon by a fixing device that is not illustrated, and the resultant transfer paper is ejected from the device. Meanwhile, the untransferred toner on the photoconductor 110 after the transfer is removed and collected by the cleaning device 160, and the residual charge of the photoconductor is eliminated by the charge-eliminating lamp 170 to be ready for next charging. A color image is typically formed with 4 color toners. In one sheet of a color image, 4 layers of toner layers are formed. The toner layers are passed through primary transfer (transfer from the photoconductor to the intermediate transfer belt) and secondary transfer (from the intermediate transfer belt to the sheet).

EXAMPLES

The present disclosure will be described in more detail through Examples and Comparative Examples below. However, the present disclosure should not be construed as being limited to these Examples. Note that, "part(s)" denotes "part(s) by mass" unless otherwise stated.

<Production of Polyester Resin>

A reaction tank equipped with a cooling tube, a stirrer, and a nitrogen-inlet tube was charged with 258 parts of a propylene oxide (2 mol) adduct of bisphenol A, 1,344 parts of an ethylene oxide (2 mol) adduct of bisphenol A, 800 parts of terephthalic acid, and 1.8 parts of tetrabutoxy titanate serving as a condensation catalyst. The resultant mixture was allowed to react for 6 hours at 230 degrees Celsius under a flow of nitrogen gas with removing generated water. Subsequently, the resultant was allowed to react for 1 hour under reduced pressure of from 5 mmHg through 20 mmHg, followed by cooling to 180 degrees Celsius. To the resultant, thereafter, 10 parts of trimellitic anhydride was added. The resultant mixture was allowed to react under reduced pressure of from 5 mmHg through 20 mmHg until a weight average molecular weight reached 30,000 and a number average molecular weight reached 2,300, to thereby obtain a polyester resin.

<Production of Monoester Wax>

A 1 L 4-necked flask equipped with a thermometer, a nitrogen-inlet tube, a stirrer, and a cooling tube was charged with, as fatty acid components, 50 parts by mass of cerotic acid and 50 parts by mass of palmitic acid, and as an alcohol component, 100 parts by mass of ceryl alcohol in a manner that a total amount of the mixture was to be 500 g. The resultant mixture was allowed to react for 15 hours or longer under atmospheric pressure under a flow of nitrogen gas with removing a reaction product at 220 degrees Celsius, to thereby obtain monoester wax having a melting point of 70.5 degrees Celsius.

<Production of External Additive>

<<Production of External Additive 1>>

As production of fumed silica used in External Additive 1, the fumed silica was generated through the following reaction using as tetrachlorosilica as a raw material and using a burner combustion system (chemical flame) of flammable gas.

$$SiCl_4+2H_2+O_2 \rightarrow SiO_2+4HCl$$

Tetrachlorosilane was mixed with hydrogen and air in advance. The tetrachlorosilane was supplied from a top edge of a cylindrical reaction vessel and a combustion reaction was performed using a multitube burner, to thereby obtain fumed silica.

Note that, a blending ratio of gas was adjusted in a manner that a volume ratio between tetrachlorosilane, hydrogen gas, and air was to be 1:5:14.

The obtained fumed silica was subjected to pulverization treatments in the order of a treatment by a roll crusher pulverizer, and a treatment by a bead mill pulverizer, to thereby obtain silica particles.

The roll crusher pulverizer performed rough pulverization under the conditions that a roll gap was 0.2 mm, and roll rotational speed was 250 rpm.

The obtained dry powder was classified using vibration sieves having an opening size of 25 micrometers and opening size of 75 micrometers, to thereby obtain silica powder having a volume average particle diameter D50 of 45 micrometers.

To the silica powder obtained by the above-mentioned method, water and a dispersing agent were added to adjust a concentration of the resultant to 15 percent to thereby prepare a slurry of silica particles. Thereafter, a pulverization treatment was performed using a bead mill pulverizer for about 5 hours at a rotor rotational speed of 3,600 rpm.

During the pulverization treatment, 100 g of beads having diameters of 500 micrometers were used as beads, and an amount of the slurry was 1,500 mL. The slurry obtained in the above-mentioned manner was spray dried by means of a spray drier at a slurry supply rate of 1 L/h, spray pressure of 2 kg/cm$^2$, and a hot air temperature of 150 degrees Celsius, to thereby obtain silica particles.

A fluidized-bed reactor was charged with 2 kg of the above-obtained silica particles. To the fluidized-bed reactor heated at 450 degrees Celsius, dimethyldichlorosilane was supplied for 40 minutes at 8 g/min using nitrogen to perform a hydrophobic treatment on surfaces of the silica particles, to thereby obtain External Additive 1 having a volume average particle diameter of 163 nm and a BET specific surface area of 101 m$^2$/g.

<Measurement of External Additive Particles>

Out of the produced external additive, particles having equivalent circle diameters of 10 nm or greater were observed per se to measure a particle size distribution.

The measurement was performed by means of a transmission electron microscopy (JEM-2100, available from JEOL Ltd.). Note that, the measurement was performed with 130 particles.

An observation sample was produced by dispersing an ethanol dispersion liquid including 0.4 percent by weight of the external additive for about 1 hour by means of a ultrasonic cleaner to adhere the external additive to a mesh attached with a collodion membrane (available from Nisshin EM Co., Ltd.). An image was obtained using the obtained observation sample. The obtained image was binarized using image processing software, A-zou kun (available from Asahi Kasei Engineering Corporation), to thereby obtain a value of an equivalent circle diameter. From the equivalent circle diameter, a volume was calculated. A volume average particle diameter was obtained by dividing a sum of products of each particle diameter and volume with a sum of volumes ([total of (particle diameter×volume) of measured particles/total of volumes of measured particles]).

Specifically, the volume average particle diameter was calculated using "Equivalent Circle Diameter 2" obtained by a particle analysis mode of A-zou kun.

The details of analysis conditions were as follows.

Binarization method (threshold): manual setting (visually)

Range designation: yes

Outer rim correction: no

Gap filling: yes

Contraction separation: no

A BET specific surface area was measured by a nitrogen adsorption method (Macsorb model-1201, available from MOUNTECH Co., Ltd.).

<<Production of External Additive 2>>

External Additive 2 were obtained in the same manner as in the production of External Additive 1, except that the combustion temperature and the pulverization duration performed by the bead mill pulverizer were changed as presented in Table 1.

<<Production of External Additive 3>>

External Additive 3 were obtained in the same manner as in the production of External Additive 1, except that the combustion temperature, and the rotor rotational speed and pulverization duration performed by the bead mill pulverizer were changed as presented in Table 1.

<<Production of External Additive 4>>

External Additive 4 were obtained in the same manner as in the production of External Additive 1, except that the combustion temperature and the pulverization duration performed by the bead mill pulverizer were changed as presented in Table 1.

<<Production of External Additive 5>>

External Additive 5 were obtained in the same manner as in the production of External Additive 1, except that the combustion temperature and the pulverization duration performed by the bead mill pulverizer were changed as presented in Table 1.

<<Production of External Additive 6>>

External Additive 6 were obtained in the same manner as in the production of External Additive 1, except that the combustion temperature was changed as presented in Table 1.

<<Production of External Additive 7>>

External Additive 7 were obtained in the same manner as in the production of External Additive 1, except that the combustion temperature, and the rotor rotational speed and pulverization duration performed by the bead mill pulverizer were changed as presented in Table 1.

<<Production of External Additive 8>>

External Additive 8 were obtained in the same manner as in the production of External Additive 1, except that the combustion temperature and the pulverization duration performed by the bead mill pulverizer were changed as presented in Table 1.

<<Production of External Additive 9>>

External Additive 9 were obtained in the same manner as in the production of External Additive 1, except that the combustion temperature, and the rotor rotational speed and pulverization duration performed by the bead mill pulverizer were changed as presented in Table 1.

<<Production of External Additive 10>>

External Additive 10 were obtained in the same manner as in the production of External Additive 1, except that the combustion temperature and the pulverization duration performed by the bead mill pulverizer were changed as presented in Table 1.

<<Production of External Additive 11>>

External Additive 11 were obtained in the same manner as in the production of External Additive 1, except that the combustion temperature and the pulverization duration performed by the bead mill pulverizer were changed as presented in Table 1.

<<Production of External Additive 12>>

External Additive 12 were obtained in the same manner as in the production of External Additive 1, except that the combustion temperature and the pulverization duration performed by the bead mill pulverizer were changed as presented in Table 1.

<<Production of External Additive 13>>

External Additive 13 were obtained in the same manner as in the production of External Additive 1, except that the combustion temperature and the pulverization duration performed by the bead mill pulverizer were changed as presented in Table 1.

<<Production of External Additive 14>>

An existing product, silica particles (UFP-35HH, available from Denka Company Limited), was used as External Additive 14.

<<Production of External Additive 15>>

A 2 L reaction vessel equipped with a stirrer was charged with 100 parts of ethanol, 200 parts of water, 370 parts of 15 percent by weight ammonia water. The resultant mixture was heated to 27 degrees Celsius with stirring. While mixing the resultant liquid mixture, thereafter, 50 parts of tetraethoxy silane (TEOS) and 45 parts of 5 percent by weight of ammonia water were continuously added at a supply rate of 10 g/min.

After filtering the obtained solution, the resultant was dried for 24 hours at 100 degrees Celsius, to thereby obtain silica particles.

A fluidized-bed reactor was charged with 2 kg of the above-obtained silica particles. The silica particles were heated to 450 degrees Celsius. To the reactor, dimethyldichlorosilane was supplied for 40 minutes at 8 g/min to thereby obtain External Additive 15 whose surfaces were hydrophobic treated, where External Additive 15 had a volume average particle diameter of 297 nm and a BET specific surface area of 11 $m^2/g$.

TABLE 1

| | Production conditions | | | | Properties of external additives | |
|---|---|---|---|---|---|---|
| | Bead mill pulverizer | | | | | |
| External additive No. | Bead diameter (mm) | Rotor rotational speed (rpm) | Pulverization duration (h) | Combustion temperature (degrees Celsius) | Volume average diameter (nm) | BET specific surface area ($m^2/g$) |
| 1 | 0.5 | 3600 | 5 | 1820 | 163 | 101 |
| 2 | 0.5 | 3600 | 5.5 | 1790 | 155 | 104 |

TABLE 1-continued

| External additive No. | Production conditions: Bead mill pulverizer: Bead diameter (mm) | Rotor rotational speed (rpm) | Pulverization duration (h) | Combustion temperature (degrees Celsius) | Properties of external additives: Volume average diameter (nm) | BET specific surface area ($m^2/g$) |
|---|---|---|---|---|---|---|
| 3 | 0.5 | 3400 | 4 | 1900 | 180 | 92 |
| 4 | 0.5 | 3600 | 6 | 1805 | 130 | 120 |
| 5 | 0.5 | 3600 | 3 | 1220 | 200 | 103 |
| 6 | 0.5 | 3600 | 5 | 1750 | 158 | 98 |
| 7 | 0.5 | 3400 | 4.5 | 1880 | 174 | 106 |
| 8 | 0.5 | 3600 | 4.5 | 1212 | 172 | 73 |
| 9 | 0.5 | 3300 | 4 | 1260 | 187 | 114 |
| 10 | 0.5 | 3600 | 6.5 | 1780 | 112 | 137 |
| 11 | 0.5 | 3600 | 2.5 | 1240 | 221 | 93 |
| 12 | 0.5 | 3600 | 4 | 1750 | 156 | 90 |
| 13 | 0.5 | 3600 | 3.5 | 1340 | 190 | 121 |
| 14 | — | — | — | — | 104 | 20 |
| 15 | — | — | — | — | 297 | 11 |

<Production of Toner>

<<Production of Toner Base Particles>>

Polyester resin (Mw: 30,000, Mn: 2,300): 90.0 parts

Styrene-acryl copolymer (EXD-001 available from Sanyo Chemical Industries, Ltd.) (Tg: 68 degrees Celsius, Mw: 13,000): 5.0 parts Monoester wax (melting point (mp): 70.5 degrees Celsius): 5.0 parts Zirconium salicylate derivative (product name: TN-105, manufacturer's name: Hodogaya Chemical Co., Ltd.): 0.9 parts The toner raw materials above were pre-mixed by means of Henschel Mixer (FM20B, available from NIPPON COKE & ENGINEERING CO., LTD.), followed by melting and kneading the resultant mixture by means of a single-screw kneader (Kneader cokneader, available from Buss AG) at a temperature of from 100 degrees Celsius through 130 degrees Celsius. After cooling the obtained kneaded product to room temperature, the kneaded product was roughly pulverized by means of Rotoplex into the size of from 200 micrometers through 300 micrometers. Subsequently, the resultant was finely pulverized by means of a counter jet mill (100AFG, available from HOSOKAWA MICRON CORPORATION) with appropriately adjusting the pulverization air pressure in a manner that a weight average particle diameter of the resultant was to be 5.4±0.3 micrometers. Thereafter, the resultant particles were classified by means of an air classifier (EJ-LABO, available from MATSUBO Corporation) with adjusting an opening degree of a louver in a manner that a weight average particle diameter of the resultant was to be 5.8±0.4 micrometers and a ratio of the weight average particle diameter to a number average particle diameter was to be 1.25 or less, to thereby obtain toner base particles. Note that, all of the toners evaluated in the present disclosure used the identical base particles.

Example 1

To the toner base particles, External Additive 1 was added in a manner that a surface covering ratio was to be 30 percent.

For a mixing treatment of the toner base particles and External Additive 1, Henschel Mixer (FM20C/I, available from NIPPON COKE & ENGINEERING CO., LTD.) was used, and a mixing operation including rotation for 1 min at a rotational speed of 3,176 rpm and suspending for 1 min was repeated 20 times to thereby obtain Toner 1 (total mixing duration: 20 min).

Example 2

Toner 2 was produced in the same manner as in the production of Toner 1, except that External Additive 2 was used.

Example 3

Toner 3 was produced in the same manner as in the production of Toner 1, except that External Additive 3 was used.

Example 4

Toner 4 was produced in the same manner as in the production of Toner 1, except that External Additive 4 was used.

Example 5

Toner 5 was produced in the same manner as in the production of Toner 1, except that External Additive 5 was used.

Example 6

Toner 6 was produced in the same manner as in the production of Toner 1, except that External Additive 6 was used.

Example 7

Toner 7 was produced in the same manner as in the production of Toner 1, except that External Additive 7 was added.

Example 8

Toner 8 was produced in the same manner as in the production of Toner 1, except that External Additive 8 was added.

Example 9

Toner 9 was produced in the same manner as in the production of Toner 1, except that External Additive 9 was added.

Example 10

Toner 10 was produced in the same manner as in the production of Toner 1, except that the mixing time by Henschel Mixer was changed to 16 min.

Example 11

Toner 11 was produced in the same manner as in the production of Toner 1, except that the mixing time by Henschel Mixer was changed to 24 min.

Comparative Example 1

Toner 12 was produced in the same manner as in the production of Toner 1, except that External Additive 10 was added.

Comparative Example 2

Toner 13 was produced in the same manner as in the production of Toner 1, except that External Additive 11 was added.

Comparative Example 3

Toner 14 was produced in the same manner as in the production of Toner 1, except that External Additive 12 was added.

Comparative Example 4

Toner 15 was produced in the same manner as in the production of Toner 1, except that External Additive 13 was added.

Comparative Example 5

Toner 16 was produced in the same manner as in the production of Toner 1, except that External Additive 14 was added.

Comparative Example 6

Toner 17 was produced in the same manner as in the production of Toner 1, except that External Additive 15 was added.

Comparative Example 7

Toner 18 was produced in the same manner as in the production of Toner 1, except that the mixing time by Henschel Mixer was changed to 6 min.

Comparative Example 8

Toner 19 was produced in the same manner as in the production of Toner 1, except that the mixing time by Henschel Mixer was changed to 30 min.

<Measurements of Equivalent Circle Diameter, Volume Average Particle Diameter, Area Ratio (Circumscribed Circle Area/Particle Area) of External Additive Attached to Toner>

Images of the toners of Examples 1 to 11 and Comparative Examples 1 to 8 were each obtained by means of scanning electron microscope SU8200 series (available from Hitachi High-Technologies Corporation). Note that, each measurement was performed with 630 particles.

An observation sample was produced by dispersing an ethanol dispersion liquid including 0.4 percent by weight of the external additive for about 1 hour by means of a ultrasonic cleaner to adhere the external additive to a mesh attached with a collodion membrane (available from Nisshin EM Co., Ltd.).

The obtained image was binarized using image processing software, A-zou kun (available from Asahi Kasei Engineering Corporation), and an equivalent circle diameter, a particle area, a circumscribed circle area, and a volume average particle diameter were calculated using the values of "Equivalent Circle Diameter 2," "Area," and "Circumscribed Circle Diameter" obtained by a particle analysis mode of the image processing software.

The particle area was a value of "Area" obtained by the binarization. The circumscribed circle area was calculated from "Circumscribed Circle Diameter" obtained by the binarization.

The area ratio (circumscribed circle area/particle area) was obtained by dividing the above-obtained "average of circumscribed circle areas" with "average of particle areas."

The details of analysis conditions were as follows.

Binarization method (threshold): manual setting (visually)

Range designation: yes

Outer rim correction: no

Gap filling: yes

Contraction separation: no

A volume average particle diameter was obtained using the same software by dividing a sum of products of each particle diameter and volume with a sum of volumes ([total of (particle diameter×volume) of measured particles/total of volumes of measured particles]).

Note that, the volume average particle diameter of the external additive in Table 2 means the volume average particle diameter measured in the state where the external additive is attached to the toner base particles.

TABLE 2

| | External additive No. | Toner No. | Volume average particle diameter of external additives (nm) | Circumscribed circle area ($nm^2$) | Particle area ($nm^2$) | Area ratio (circumscribed circle area/particle area) | State of particles having equivalent circle diameters of 10 nm or greater | Type of silica |
|---|---|---|---|---|---|---|---|---|
| Ex. 1 | 1 | 1 | 109 | 7166 | 4082 | 1.76 | Aggregates | Fumed |
| Ex. 2 | 2 | 2 | 90 | 4905 | 2829 | 1.73 | Aggregates | Fumed |
| Ex. 3 | 3 | 3 | 130 | 10378 | 5830 | 1.78 | Aggregates | Fumed |
| Ex. 4 | 4 | 4 | 82 | 3848 | 2290 | 1.68 | Aggregates | Fumed |
| Ex. 5 | 5 | 5 | 140 | 12328 | 6874 | 1.79 | Aggregates | Fumed |

TABLE 2-continued

| | External additive No. | Toner No. | Volume average particle diameter of external additives (nm) | Circumscribed circle area ($nm^2$) | Particle area ($nm^2$) | Area ratio (circumscribed circle area/particle area) | State of particles having equivalent circle diameters of 10 nm or greater | Type of silica |
|---|---|---|---|---|---|---|---|---|
| Ex. 6 | 6 | 6 | 112 | 7420 | 4496 | 1.65 | Aggregates | Fumed |
| Ex. 7 | 7 | 7 | 118 | 9889 | 4994 | 1.98 | Aggregates | Fumed |
| Ex. 8 | 8 | 8 | 112 | 6970 | 4356 | 1.60 | Aggregates | Fumed |
| Ex. 9 | 9 | 9 | 120 | 13626 | 5281 | 2.58 | Aggregates | Fumed |
| Ex. 10 | 1 | 10 | 109 | 7172 | 4122 | 1.74 | Aggregates | Fumed |
| Ex. 11 | 1 | 11 | 107 | 6917 | 3907 | 1.77 | Aggregates | Fumed |
| Comp. Ex. 1 | 10 | 12 | 60 | 1998 | 1241 | 1.61 | Aggregates | Fumed |
| Comp. Ex. 2 | 11 | 13 | 156 | 22995 | 8947 | 2.57 | Aggregates | Fumed |
| Comp. Ex. 3 | 12 | 14 | 104 | 8395 | 5597 | 1.50 | Aggregates | Fumed |
| Comp. Ex. 4 | 13 | 15 | 137 | 18214 | 6391 | 2.85 | Aggregates | Fumed |
| Comp. Ex. 5 | 14 | 16 | 112 | 8245 | 6680 | 1.23 | Primary particles | Fumed |
| Comp. Ex. 6 | 15 | 17 | 251 | 48806 | 32601 | 1.50 | Aggregates + Primary particles | Sol-gel |
| Comp. Ex. 7 | 1 | 18 | 128 | 13905 | 5247 | 2.65 | Aggregates | Fumed |
| Comp. Ex. 8 | 1 | 19 | 95 | 5889 | 3780 | 1.55 | Aggregates | Fumed |

<Production of Two-Component Developer>

<<Production of Carrier>>

Silicone resin (organo straight silicone): 100 parts

Toluene: 100 parts

Gamma-(2-aminoethyl)aminopropyltrimethoxysilane: 5 parts

Carbon black: 10 parts

The mixture above was dispersed for 20 minutes by a homomixer to prepare a coating layer-forming liquid. The coating layer-forming liquid was applied to surfaces of spherical ferrite particles having an average particle diameter of 35 micrometers by means of a fluidized bed coating device in a manner that an average film thickness of the coating layer was to be 0.20 micrometers, to thereby form an inner resin layer. Coating and drying of the coating layer-forming liquid were performed by means of the fluidized bed coating device with controlling a temperature of each fluidized bed to 70 degrees Celsius. The obtained carrier was fired for 2 hours at 180 degrees Celsius in an electric furnace and a particle size thereof was adjusted by sieving to thereby obtain a carrier.

The produced carrier and Toner 1 were homogeneously mixed to charge by means of TURBULA mixer (available from Willy A. Bachofen (WAB) AG Maschinenfabrik) for 5 minutes at 48 rpm to thereby produce a Two-Component Developer 1. Note that, a mixing ratio between the toner and the carrier was adjusted to a toner density (4 percent by mass) of an initial developer of an evaluation device.

Two-Component Developers 2 to 19 were produced in the same manner as in the production of Two-Component Developer 1, except that Toner 1 was replaced with Toners 2 to 19, respectively.

<Amount of Toner Loose Aggregates After High Temperature High Humidity Storage>

An amount of toner loose aggregates after storing at a high temperature and high humidity was evaluated on Toners 1 to 19 obtained in the following manner. The toner was weighed in a container by 10 g and was stored for 14 days under the temperature and humidity conditions of 40 degrees Celsius and 70 percent. Thereafter, the toner after the storage was sieved by a sieve having an opening size of 106 micrometers and was evaluated based on the following evaluation criteria. The evaluation results are presented in Table 3.

Excellent: no loose aggregates at all

Good: greater than 0.0 mg but 1.0 mg or less

Poor: greater than 1.0 mg

The obtained two-component developer was set in an evaluation device prepared by removing a lubricant applying system from a digital full-color multifunction peripheral (MP C306, available from Ricoh Company Limited) and the following evaluations were performed. The evaluation results are presented in Table 3.

<Cleaning Properties>

Transfer residual toner on the photoconductor which had passed a cleaning step after outputting 40,000 sheets of a 5 percent image density chart was transferred to white paper with SCOTCH TAPE (available from Sumitomo 3M Limited). The transferred residual toner was measured by means of X-Rite938 (available from X-Rite). The result was evaluated with a difference from a blank based on the following evaluation criteria.

Excellent: less than 0.005

Good: 0.005 or greater but 0.010 or less

Fair: 0.011 or greater but 0.02 or less

Poor: greater than 0.02

<Prevention of Photoconductor Pollution>

An amount of the components attached on the photoconductor after outputting 2,000 sheets of a 5 percent image density chart was visually evaluated based on the following evaluation criteria.

Excellent: No deposition at all.

Good: Slightly clouded marks or adherent was observed.

Fair: Clouded lines or trace of adherent can be observed but not visible on an image.

Poor: A clouded area or adherent is significant, or transfer failures occur, which are visible on an image.

TABLE 3

| | Toner No. | Two-component developer No. | Evaluation results: Amount of loose toner aggregates | Cleaning properties | Prevention of photo-conductor pollution |
|---|---|---|---|---|---|
| Ex. 1 | 1 | 1 | Excellent | Excellent | Excellent |
| Ex. 2 | 2 | 2 | Excellent | Excellent | Excellent |

TABLE 3-continued

| | Toner No. | Two-component developer No. | Evaluation results: Amount of loose toner aggregates | Cleaning properties | Prevention of photo-conductor pollution |
|---|---|---|---|---|---|
| Ex. 3 | 3 | 3 | Excellent | Excellent | Excellent |
| Ex. 4 | 4 | 4 | Good | Good | Excellent |
| Ex. 5 | 5 | 5 | Excellent | Excellent | Good |
| Ex. 6 | 6 | 6 | Excellent | Excellent | Excellent |
| Ex. 7 | 7 | 7 | Excellent | Excellent | Excellent |
| Ex. 8 | 8 | 8 | Good | Fair | Good |
| Ex. 9 | 9 | 9 | Good | Excellent | Fair |
| Ex. 10 | 10 | 10 | Excellent | Excellent | Excellent |
| Ex. 11 | 11 | 11 | Excellent | Excellent | Excellent |
| Comp. Ex. 1 | 12 | 12 | Poor | Fair | Excellent |
| Comp. Ex. 2 | 13 | 13 | Excellent | Excellent | Poor |
| Comp. Ex. 3 | 14 | 14 | Good | Poor | Poor |
| Comp. Ex. 4 | 15 | 15 | Good | Excellent | Poor |
| Comp. Ex. 5 | 16 | 16 | Good | Poor | Poor |
| Comp. Ex. 6 | 17 | 17 | Excellent | Fair | Poor |
| Comp. Ex. 7 | 18 | 18 | Excellent | Fair | Poor |
| Comp. Ex. 8 | 19 | 19 | Poor | Good | Fair |

For example, embodiments of the present disclosure are as follows.

<1> A toner including:

toner particles, each toner particle includes:

a base particle including a binder resin; and external additive particles, wherein the external additive particles include particles each having an equivalent circle diameter of 10 nm or greater, a volume average particle diameter of the particles each having an equivalent circle diameter of 10 nm or greater is 80 nm or greater but 140 nm or less, and a ratio (circumscribed circle area/particle area) of a circumscribed circle area of the particle having an equivalent circle diameter of 10 nm or greater to a particle area of the particle having an equivalent circle diameter of 10 nm or greater is 1.60 or greater but 2.60 or less.

<2> The toner according to <1>, wherein the particle having an equivalent circle diameter of 10 nm or greater is an aggregate.

<3> The toner according to <1> or <2>, wherein the particle having an equivalent circle diameter of 10 nm or greater is an inorganic particle.

<4> The toner according to <3>, wherein the inorganic particle is at least one selected from the group consisting of silica, titanium oxide, strontium titanate, and alumina.

<5> The toner according to <4>, wherein the silica is fumed silica.

<6> A toner stored unit including:

a unit; and the toner according to any one of <1> to <5> stored in the unit.

<7> An image forming apparatus including:

an electrostatic latent image bearer;

an electrostatic latent image forming unit configured to form an electrostatic latent image on the electrostatic latent image bearer;

a developing unit configured to develop the electrostatic latent image formed on the electrostatic latent image bearer with a toner to form a toner image where the developing unit includes the toner;

a transferring unit configured to transfer the toner image formed on the electrostatic latent image bearer to a surface of a recording medium; and a fixing unit configured to fix the transferred toner image onto the surface of the recording medium, wherein the toner is the toner according to any one of <1> to <5>.

<8>

The image forming apparatus according to <7>, wherein the image forming apparatus does not include a lubricant applying unit configured to apply a lubricant onto the electrostatic latent image bearer.

The toner according to <1> to <5>, the toner stored unit according to <6>, and the image forming apparatus according to <7> to <8> can solve the various problems existing in the art and achieve the object of the present disclosure.

REFERENCE SIGNS LIST

110: photoconductor
120: charging roller
160: cleaning device

The invention claimed is:

1. A toner, comprising:

toner particles, wherein each toner particle includes:

a base particle including a hinder resin; and external additive particles, wherein the external additive particles include particles each having an equivalent circle diameter of 10 nm or greater, a volume average particle diameter of the particles each having an equivalent circle diameter of 10 nm or greater is 90 nm or greater but 130 nm or less, wherein the volume average particle diameter is calculated as a volume-weighted average of the equivalent circle diameter of the particles, and a ratio (circumscribed circle area/particle area) of a circumscribed circle area of the particle having an equivalent circle diameter of 10 nm or greater to a particle area of the particle having an equivalent circle diameter of 10 nm or greater is 1.65 or greater hut 2.00 or less.

2. The toner according to claim 1, wherein the particle having an equivalent circle diameter of 10 nm or greater is an aggregate.

3. The toner according to claim 1, wherein the particle having an equivalent circle diameter of 10 nm or greater is an inorganic particle.

4. The toner according to claim 3, wherein the inorganic particle is at least one selected from the group consisting of silica, titanium oxide, strontium titanate, and alumina.

5. The toner according to claim 4, wherein the silica is fumed silica.

6. A toner stored unit comprising:

a unit; and the toner according to claim 1 stored in the unit.

7. An image forming apparatus comprising:

an electrostatic latent image bearer;

an electrostatic latent image forming unit configured to form an electrostatic latent image on the electrostatic latent image bearer;

a developing unit configured to develop the electrostatic latent image formed on the electrostatic latent image bearer with a toner to form a toner image where the developing unit includes the toner;

a transferring unit configured to transfer the toner image formed on the electrostatic latent image bearer to a surface of a recording medium; and a fixing unit configured to fix the transferred toner image onto the surface of the recording medium, wherein the toner is the toner according to claim 1.

8. The image forming apparatus according to claim 7, wherein the image forming apparatus does not include a lubricant applying unit configured to apply a lubricant onto the electrostatic latent image bearer.

* * * * *